US009642453B2

(12) United States Patent
Feinberg et al.

(10) Patent No.: US 9,642,453 B2
(45) Date of Patent: May 9, 2017

(54) COLLAPSIBLE SUPPORT DEVICE FOR HOLDING AN OBJECT

(71) Applicant: Jeffrey N. Feinberg, Vestal, NY (US)

(72) Inventors: Jeffrey N. Feinberg, Vestal, NY (US); Joseph Elijio Velasquez, Fountain Hills, AZ (US)

(73) Assignee: Jeffrey N. Feinberg, Vestal, NY (US)

( * ) Notice: Subject to any disclaimer, the term of this patent is extended or adjusted under 35 U.S.C. 154(b) by 0 days.

(21) Appl. No.: 14/333,873

(22) Filed: Jul. 17, 2014

(65) Prior Publication Data

US 2016/0015141 A1 Jan. 21, 2016

(51) Int. Cl.
*A47G 1/24* (2006.01)
*A47B 23/04* (2006.01)

(52) U.S. Cl.
CPC ..... *A47B 23/042* (2013.01); *A47B 23/043* (2013.01); *A47B 23/044* (2013.01); *A45C 2200/15* (2013.01)

(58) Field of Classification Search
CPC .... A47B 23/043; A47B 23/042; A47B 23/044
USPC ..... 248/456, 441.1, 444.1, 447, 454, 455, 248/460
See application file for complete search history.

(56) References Cited

U.S. PATENT DOCUMENTS 1,203,659 A * 11/1916 Smith ..... A47B 23/043 248/456
1,564,594 A * 12/1925 Leh ..... A47B 23/043 248/448
2,014,176 A * 9/1935 Henderson ..... A47B 23/043 248/456
2,489,553 A * 11/1949 Wofford ..... A47B 23/043 190/1
2,553,971 A * 5/1951 Hunter ..... D04B 3/06 220/256.1
4,555,128 A 11/1985 White et al.
4,624,433 A * 11/1986 Henneberg ..... F16M 11/10 248/346.06
4,978,096 A * 12/1990 Struckmann ..... A47B 23/043 24/18
7,172,167 B2 * 2/2007 Phifer ..... A47B 23/042 108/11
8,123,189 B2 * 2/2012 Phifer ..... A47B 23/044 108/11
8,605,431 B2 * 12/2013 Cheng ..... F16M 11/10 248/456
2005/0023157 A1 * 2/2005 Logan ..... A45C 11/18 206/37
2005/0098703 A1 * 5/2005 Cziraky ..... B44D 3/00 248/460

(Continued)

*Primary Examiner* — Kimberly Wood
(74) *Attorney, Agent, or Firm* — Foley & Lardner LLP

(57) ABSTRACT

A collapsible support device configured to support an object in an inclined position, may include a base portion and an upper support panel. A hinge connecting the base portion to the upper support panel may be disposed at one edge of the base portion and a first edge of the upper support panel. The collapsible support device may be configured to be in at least one open position such that the base portion and the upper support panel are at an angle relative to each other and to be in a closed position such that the upper support panel lays against the base portion. The collapsible support device may be used to support the object at an inclined position in the open position.

10 Claims, 19 Drawing Sheets

(56) References Cited

U.S. PATENT DOCUMENTS

| | | | | |
|---|---|---|---|---|
| 2005/0115598 | A1* | 6/2005 | Wu | A45B 9/02 135/25.4 |
| 2006/0186303 | A1* | 8/2006 | Phifer | A47B 23/043 248/454 |
| 2010/0044543 | A1* | 2/2010 | Ramey, III | A47B 23/043 248/449 |
| 2010/0163691 | A1* | 7/2010 | Peterson | B65F 1/1415 248/99 |
| 2014/0334155 | A1* | 11/2014 | Christ | F21L 4/08 362/249.03 |
| 2015/0346777 | A1* | 12/2015 | Hosoya | F16M 11/38 361/679.56 |
| 2015/0359328 | A1* | 12/2015 | van Hooft | A47B 23/043 248/456 |

* cited by examiner

COLLAPSIBLE SUPPORT DEVICE FOR HOLDING AN OBJECT

BACKGROUND

The present invention relates to a collapsible support device which can be used hold an object in an inclined position. An object may, for example, be a book, an electronic device, a poster board, a note pad, or other substantially planar objects. The collapsible support device can also be folded into a compact configuration for portability.

Foldable reading stands, hook stands, copy holders and like devices are known, for example, U.S. Pat. No. 4,555,128 to White et al. discloses a support device that can be used as a reading stand or a writing support surface. The support device includes a base portion, an upper support panel, a hinge connecting the base portion to the support panel, and a page holder for holding the pages of a book open against the support panel. The page holder comprises an elastic hand having opposite ends attached to the support panel in which the elastic band is sufficiently long to stretch over the other side of said support panel.

SUMMARY

According to one embodiment of the present invention, a collapsible support device configured to support an object in an inclined position may comprise a base portion having at least one protrusion that extends from an upper surface of the base portion; and an upper support panel. A hinge connecting the base portion to the upper support panel may be disposed at one edge of the base portion and a first edge of the upper support panel. The collapsible support device may be configured to be in at least one open position such that the base portion and the upper support panel are at an angle relative to each other and to be in a closed position such that the upper support panel lays against the base portion. The upper support panel may comprise a substantially flat surface, at least one aperture in the substantially flat surface, and at least one tab protruding from a second edge of the upper support panel. The at least one protrusion may be configured to lock the collapsible support device in the closed position when the at least one protrusion extends through the at least one aperture.

According to another embodiment of the present invention, a collapsible support device configured to support an object in an inclined position may comprise: a base portion, an upper support panel, and an elastic hand. A hinge connecting the base portion to the upper support panel may be disposed at one edge of the base portion and a first edge of the upper support panel. The collapsible support device may be configured to be in at least one open position such that the base portion and the upper support panel are at an angle relative to each other and to be in a closed position such that the upper support panel lays against the base portion. The upper support panel may comprise a groove running along at least part of a periphery of the upper support panel. The elastic hand may have first and second ends attached to the upper support panel such that the elastic band fits inside the groove when the collapsible support device is in the closed position. The elastic band may be configured to stretch over an upper surface of the upper support panel so as to be able to hold the object on the upper surface when the collapsible support device is in the at least one open position and to contract back into the groove when the collapsible support device is in the closed position.

According to another embodiment of the present invention, a method of supporting an object at an inclined position using a collapsible support device may comprise: placing at least first and second fingers on the collapsible support device; wherein the collapsible support device comprises a base portion having at least one protrusion that extends from an upper surface of the base portion, and an upper support panel; wherein a hinge connecting the base portion to the upper support panel is disposed at one edge of the base portion and a first edge of the upper support panel; wherein the upper support panel comprises a substantially flat surface, at least one aperture in the substantially flat surface, and at least one tab protruding from a second edge of the upper support panel, wherein the at least one protrusion is configured to extend through the at least one aperture so as to keep the collapsible support device is in the closed position; applying a first force on the at least one protrusion in a first direction with the first finger and a second force on the at least one tab in a second direction with the second finger such that the protrusion is removed from the aperture; rotating the upper support panel relative to the base portion about the hinge; fixing the upper support panel relative to the base portion in at least one open position; and placing the object on the upper support panel.

It is to be understood that both the foregoing general description and the following detailed descriptions are exemplary and explanatory only, and are not restrictive of the invention as claimed.

BRIEF DESCRIPTION OF THE DRAWINGS

The features, aspects, and advantages of the present invention will become apparent from the description, appended claims, and the accompanying exemplary embodiments shown in the drawings, which are briefly described below.

FIGS. 3A-3C show side views of the collapsible support device of FIG. 1 in which FIG. 3A shows a side view with the lip in a first position, FIG. 3B shows a side view with the lip in a second position, and FIG. 3C shows a blow up view of the lip of FIG. 3A.

FIGS. 13A-13C show views of a clip for the collapsible support device of FIG. 1 in which FIG. 13A shows a perspective view, FIG. 13B shows a side view, and FIG. 3C shows a rear view.

FIGS. 16A-16B show views of a protrusion for the collapsible support device of FIG. 1 in which FIG. 16A shows a perspective view and FIG. 16B shows a side view.

FIGS. 17A-17B show views of a tab for the collapsible support device of FIG. 1 in which FIG. 17A shows a front view and FIG. 17B shows a perspective view.

DETAILED DESCRIPTION

Various embodiments of the present invention will be explained with reference to the accompanying drawings.

Figure 1:
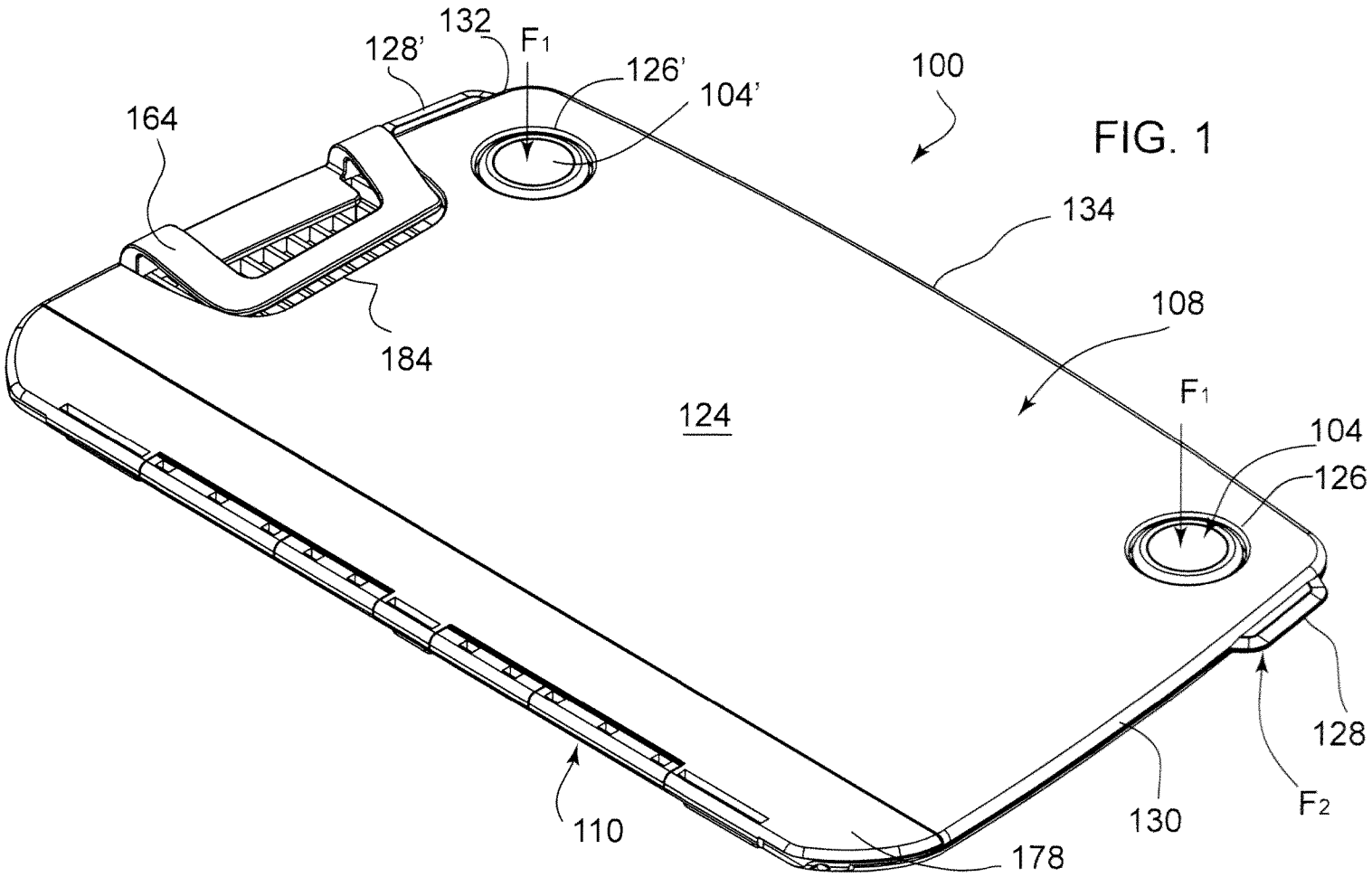
FIG. 1 shows a perspective top view of a collapsible support device in a closed position according to one embodiment of the present invention.

FIG. 1 shows a collapsible support device 100 configured to support an object in an inclined position according to one embodiment of the present invention. The collapsible support device may comprise: a base portion 102 having at least one protrusion 104 that extends from an upper surface 106 of the base portion; and an upper support panel 108.

Figure 4:
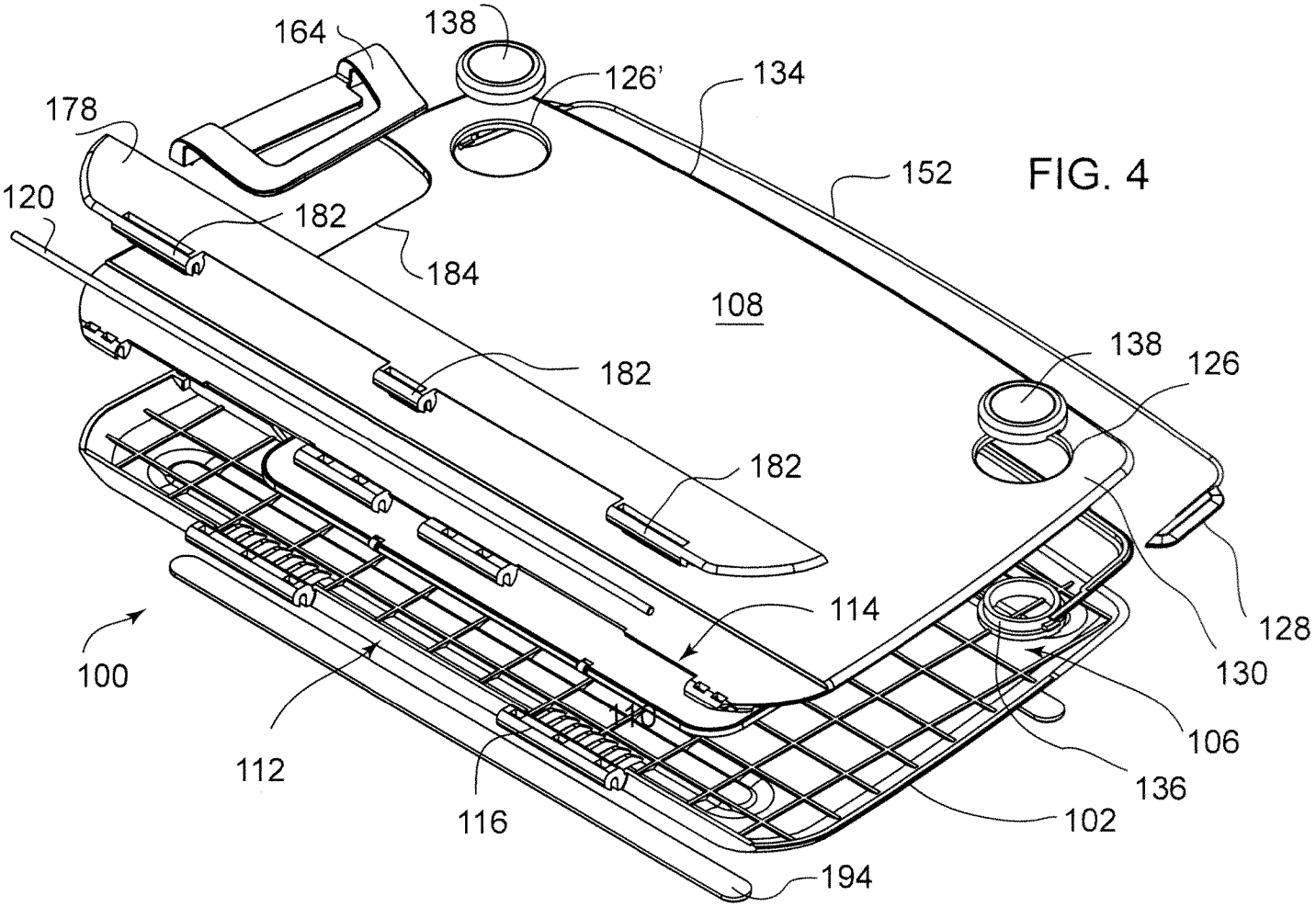
FIG. 4 shows an exploded view of the collapsible support device of FIG. 1.
Figure 11:
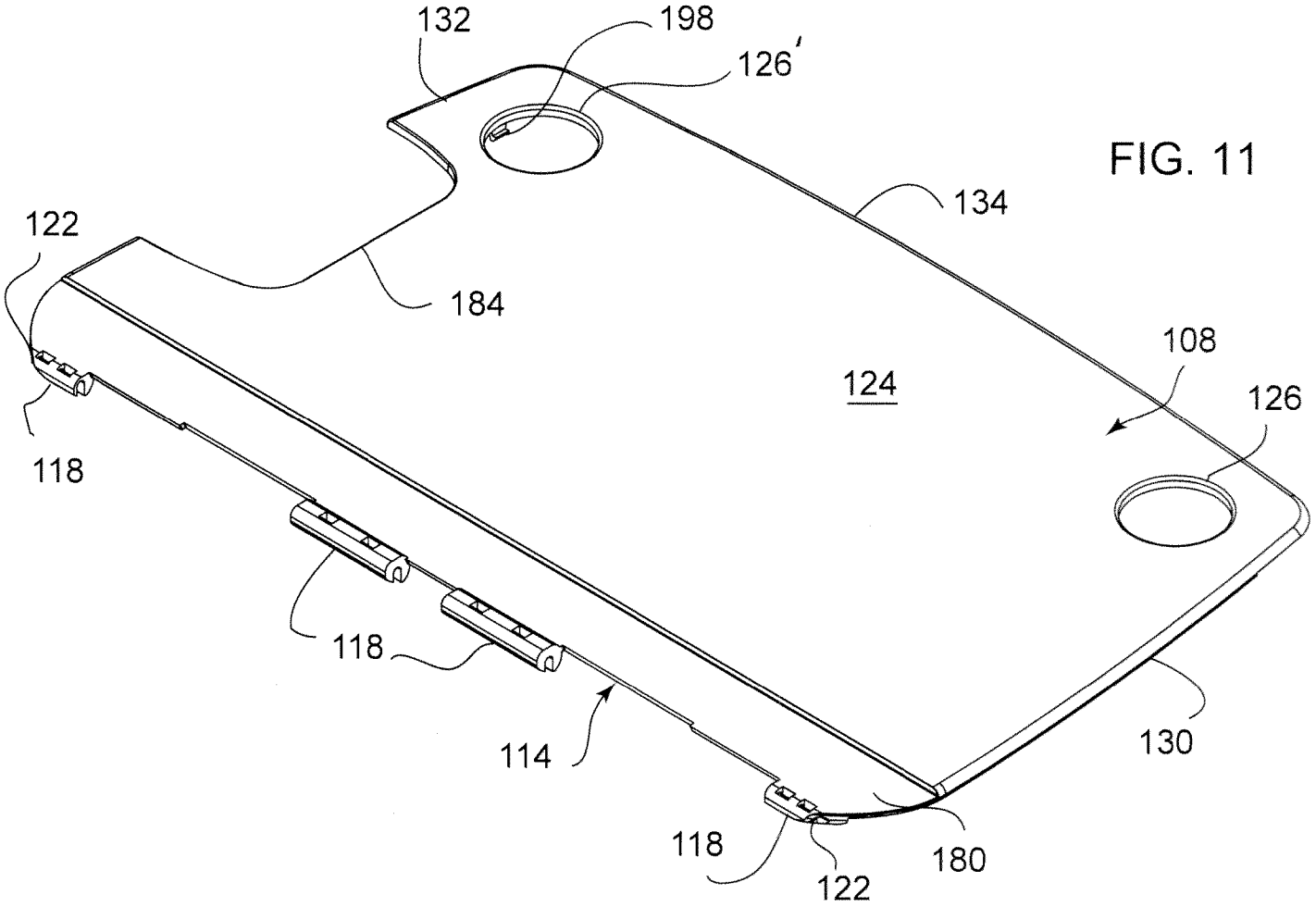
FIG. 11 shows a perspective view of an upper support panel for the collapsible support device of FIG. 1.
Figure 12:
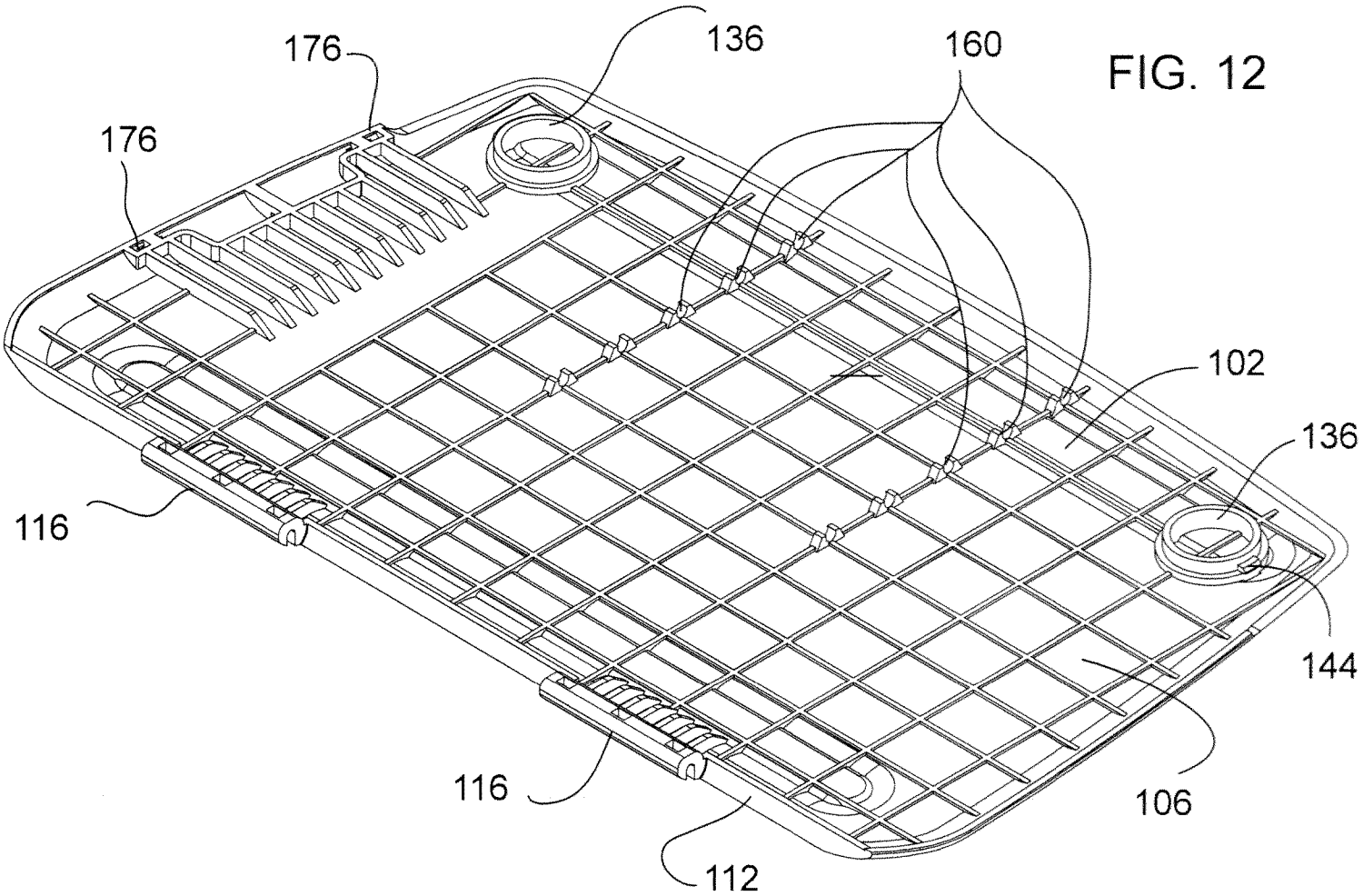
FIG. 12 shows a perspective view of a base portion for the collapsible support device of FIG. 1.

A hinge 110 connecting the base portion 102 to the upper support panel 108 is disposed at one edge 112 of the base portion and a first edge 114 of the upper support panel. The hinge 110 may be formed by one or more hinge parts 116 on the base portion (as seen in FIG. 12) and one more or more hinge parts 118 on the upper support panel (as seen in FIG. 11). According to the embodiment of FIG. 1, the hinge parts 116 are integrally formed as one-piece with the base portion, while the hinge parts 118 are integrally formed as one-piece with the upper support panel. The hinge parts 116 and 118 may be disposed in a series along the hinge 110. Each of the hinge parts 116 and 118 have apertures or notches in which a pivot rod 120 (seen in FIG. 4) is inserted. If notches are used, the pivot rod 120 is grasped between the sidewalls of the notches. If apertures are used, the pivot rod 120 is inserted through them. The pivot rod 120 may be prevent from sliding out of the notches and/or grooves in the longitudinal direction of the rod by end caps 122 disposed on the outer two hinge parts 116, 118 (seen in FIG. 11).

According to another embodiment, the hinge parts 116 may be formed separately and mounted on the base portion while the hinge parts 118 may be formed separately and mounted on the upper support panel. Furthermore according to other embodiments, the number of hinge parts 116 and 118 may vary, such as for example, there may be one, two, three, four, or more hinge parts 116 and/or one, two, three, four, or more hinge parts 118.

The base portion 102 and the upper support panel 108 rotate about the hinge 110. With this rotation, the collapsible support device is configured to be in at least one open position such that the base portion and the upper support panel are at an angle relative to each other (such as seen in FIGS. 7-10) and to be in a closed position such that the upper support panel lays against the base portion (such as seen in FIG. 1).

The upper support panel 108 comprises a substantially flat surface 124, at least one aperture 126 in the substantially flat surface 124, and at least one tab 128 protruding from a second edge 130 of the upper support panel. The substantially flat surface may be any suitable shape, such as generally rectangular, generally circular, generally square, generally polygonal, and other suitable shapes. The substantially flat surface 124 of FIG. 1 is, for example, generally rectangular in shape with a first edge 114, a second end 130, a third edge 132, and a fourth edge 134.

The aperture 126 is a through-hole that goes through the entire thickness of the substantially flat surface 124. The at least one protrusion 104 is configured to lock the collapsible support device 100 in the closed position when the at least one protrusion 104 extends through the at least one aperture 126. The number of apertures of the upper support panel 108 and their corresponding protrusions 104 may be any suitable number. For example, one, two, three, or more apertures with their corresponding protrusions may be used. In FIG. 1, for example, the base portion 102 has a second protrusion 104' that extends from the upper surface of the base portion while the upper support panel 108 comprises a second aperture 126' in the substantially flat surface. The second protrusion 104', like the protrusion 104, is configured to lock the collapsible support device 100 in the closed position when the second protrusion 104' extends through the second aperture 126'.

Also, the placement of the apertures of the upper support panel 108 and their corresponding protrusions 104 may be any suitable location. According to one embodiment, one protrusion 104 may be located in a corner of the base portion 102 while its corresponding aperture 126 is formed in a corner of the upper support panel 108. According to another embodiment, two protrusions 104 may be located in two different corners of the base portion 102 while their two corresponding apertures 126 are formed in two different corners of the upper support panel 108, as seen in FIG. 1. According to yet another embodiment, one protrusion 104 may be located adjacent to the midpoint of the fourth edge 134 while its corresponding aperture 126 is formed adjacent to the midpoint of the edge of the upper support panel 108 opposite to the hinge 100.

As mentioned above, the base portion 102 may have at least one protrusion 104 that extends from the upper surface 106 of the base portion. The base portion 102 may have a shape that generally conforms to the shape of the upper support panel. That is, like the upper support panel, the base portion 102 may be any suitable shape, such as generally rectangular, generally circular, generally square, generally polygonal, and other suitable shapes.

The at least one protrusion 104 will have a location that corresponds to the location of the aperture 126 of the upper support panel 108 when the collapsible support device 100 is in the closed position (that is, when the upper support panel lays against the base portion), as seen in FIG. 1. If there are two or more protrusions 104, 104', their respective locations will correspond to the respective locations of the corresponding apertures 126, 126' of the upper support panel 108 when the collapsible support device 100 is in the closed position, as seen in FIG. 1.

The protrusion 104 may be any suitable structure that may protrude through its corresponding aperture. FIGS. 4, 9, 12, 16A, and 16B show a protrusion according to one embodiment of the present invention. The protrusion 104 may comprise a bottom portion 136 and a cap portion 138. The bottom portion 136 may be a tube structure projecting from the upper surface 106 onto which the cap portion 138 fits onto. The bottom portion 136 may be integrally formed with the rest of the base portion 102 as one-piece. Alternatively, the bottom portion 136 may be a separate piece that is joined to the upper surface of the bottom portion by any suitable fastening mechanism, such as, for example, adhesives, screws, clips, or the like.

The cap portion 138 takes the form of a hollow cylinder 140 with an end surface 142. The hollow cylinder 140 and end surface 142 may be integrally formed as one piece or may be separate pieces that are joined together by any suitable fastening mechanism, such as, for example, adhesives, screws, clips, or the like. The end surface 142 may optionally have a depression in its center so as to generally conform to the contour of a user's finger, such as the thumb.

Figure 5:
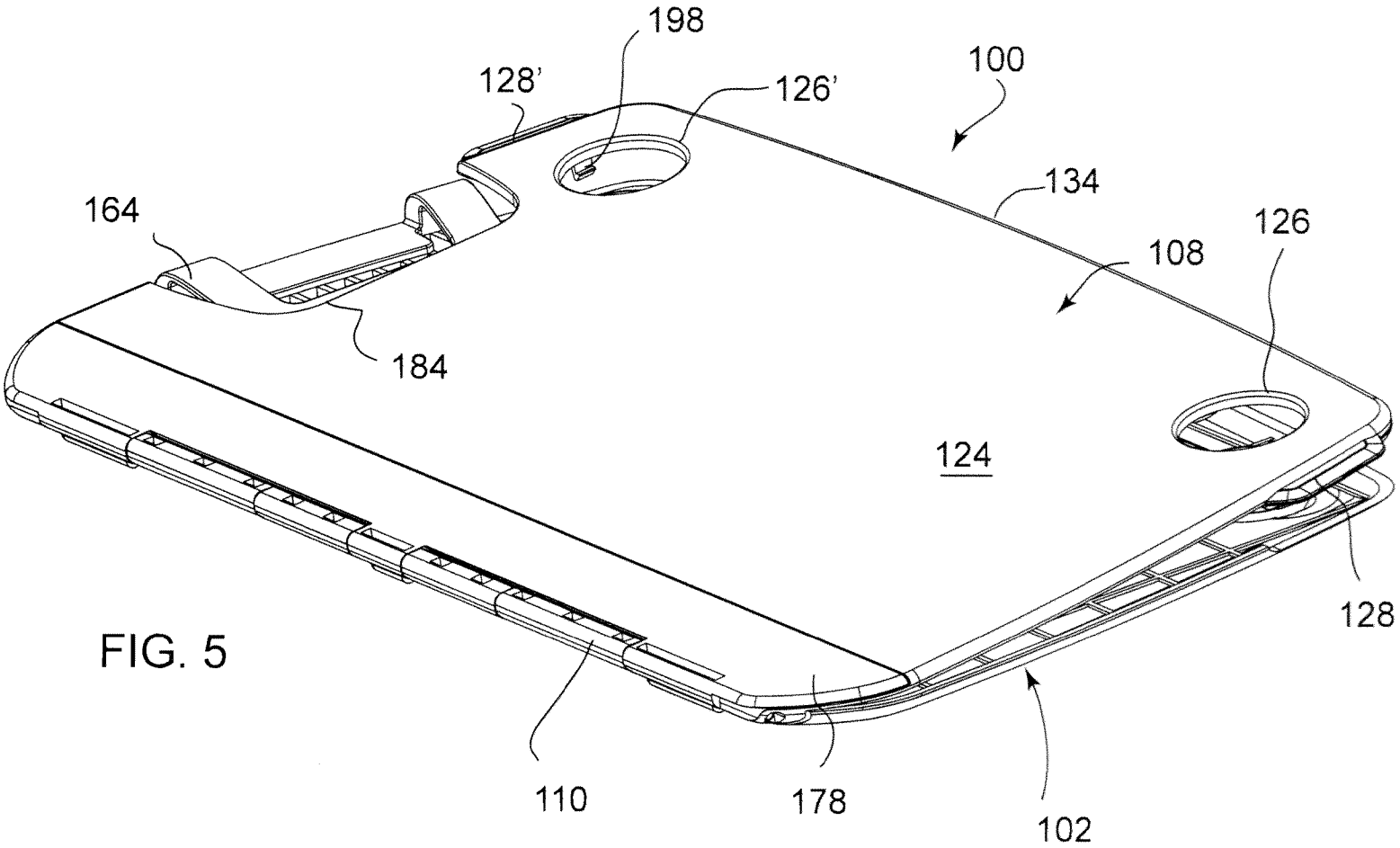
FIG. 5 shows a perspective top view of the collapsible support device of FIG. 1 that is partially open.

The cap portion 138 may fit over the bottom portion 136 such that the hollow cylinder 140 fits over the tube structure of the bottom portion. According to the embodiment of FIGS. 12, 16A, and 16B, the bottom portion 136 includes a tab 144 protruding out from a circumferential surface of the tube structure. The tab 144 abuts against a shelf 146 formed adjacent to a notch 196 in the hollow cylinder 140 so as to fix the cap portion 138 to the bottom portion 136. The notch 196 is any suitably shaped orifice that is used to receive a tab 198 attached to each of the peripheries of the apertures 126, 126' of the upper support panel 108 (see FIGS. 5-6). The tab 198 interlocking with the notch is the mechanism that holds the collapsible support device in the closed position. When the cap portions 138 are pushed by the user, the tab 198 is freed from the notch 196 so that the collapsible support device is free to move into the at least one open position.

According to another embodiment, the protrusion 104 may simply be the cap portion 138 being fixed directly to the base portion 102 by any suitable fastening mechanism, such as, for example, adhesives, screws, clips, or the like. According to another embodiment, the protrusion 104 may simply be the cap portion 138 integrally formed with the base portion 102 so as to be one-piece with the base portion 120.

The upper support panel 108 comprises the least one tab 128 protruding from the second edge 130 of the upper support panel 108. Optionally, the upper support panel 108 may comprise a second tab 128' protruding from the third edge 132 of the upper support panel. The one or more tabs 128, 128' may be any suitable shape, such as substantially rectangular, substantially semi-circular, substantially square, substantially trapezoidal, or any other suitable shape.

According to one embodiment, the one or more tabs 128, 128' may be integrally formed with the upper support panel 108 so as to be one-piece with upper support panel 108. According to another embodiment, the one or more tabs 128, 128' may be separate pieces that are attached to the rest of the upper support panel by any suitable fastening mechanism, such as, for example, adhesives, screws, clips, or the like.

FIGS. 4, 17A, 17B, and 18 show tabs according to an embodiment of the present invention. The tabs 128 and 128' are substantially trapezoidal. Along the edges 148, 148', there is a sleeve 150, 150' which receive an elastic band 152. The tabs 128, 128 are then attached to the substantially flat surface 124 of the upper support panel 108. The attachment may take the form of any suitable fastening mechanism, such as, for example, adhesives, screws, clips, or the like or by inserting the tabs into a corresponding groove at the edges 130, 132 so as to create a friction fit with or without the addition of adhesive.

Figure 8:
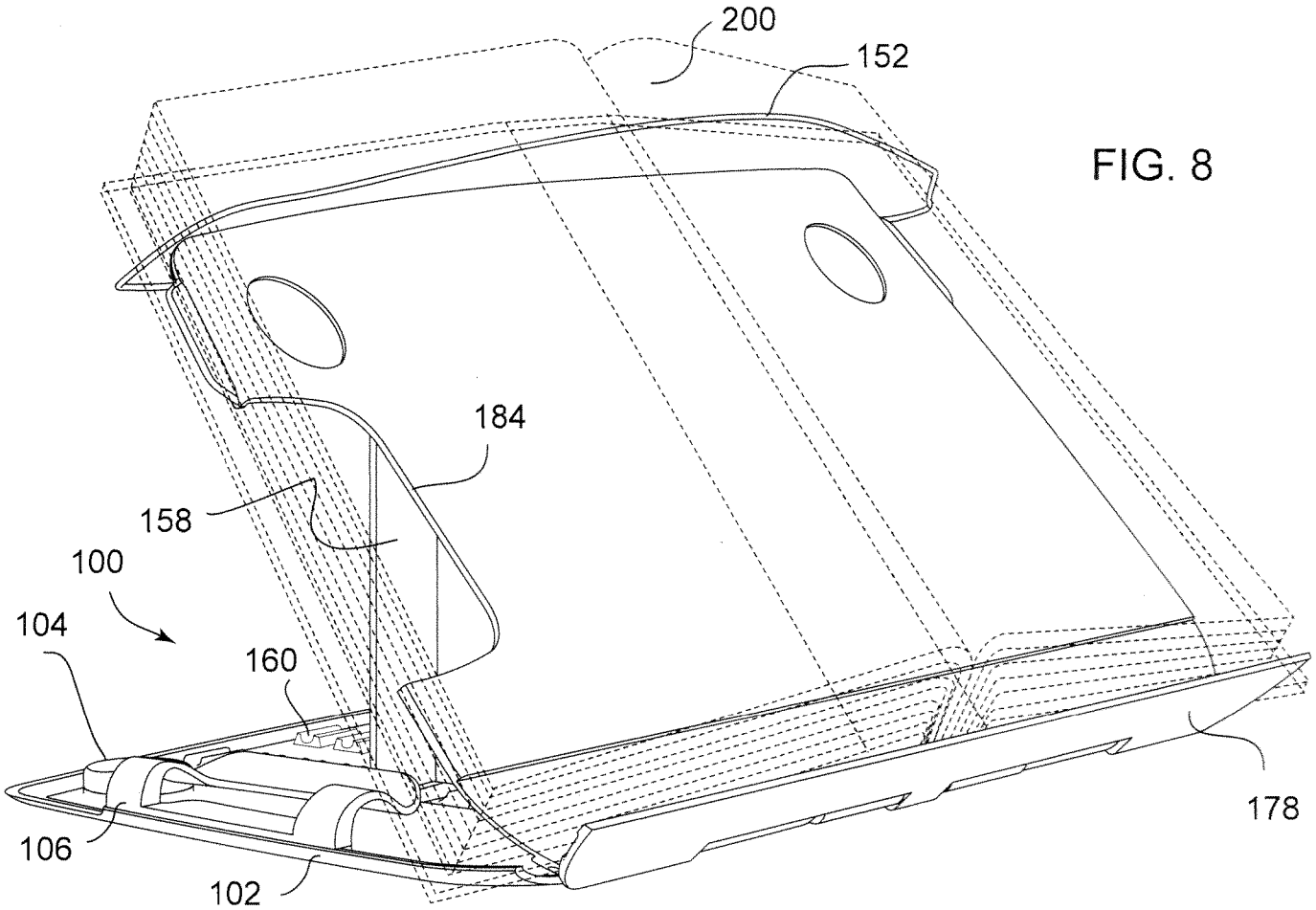
FIG. 8 shows a perspective top view of the collapsible support device of FIG. 1 in an open position with an object placed thereon.
Figure 9:
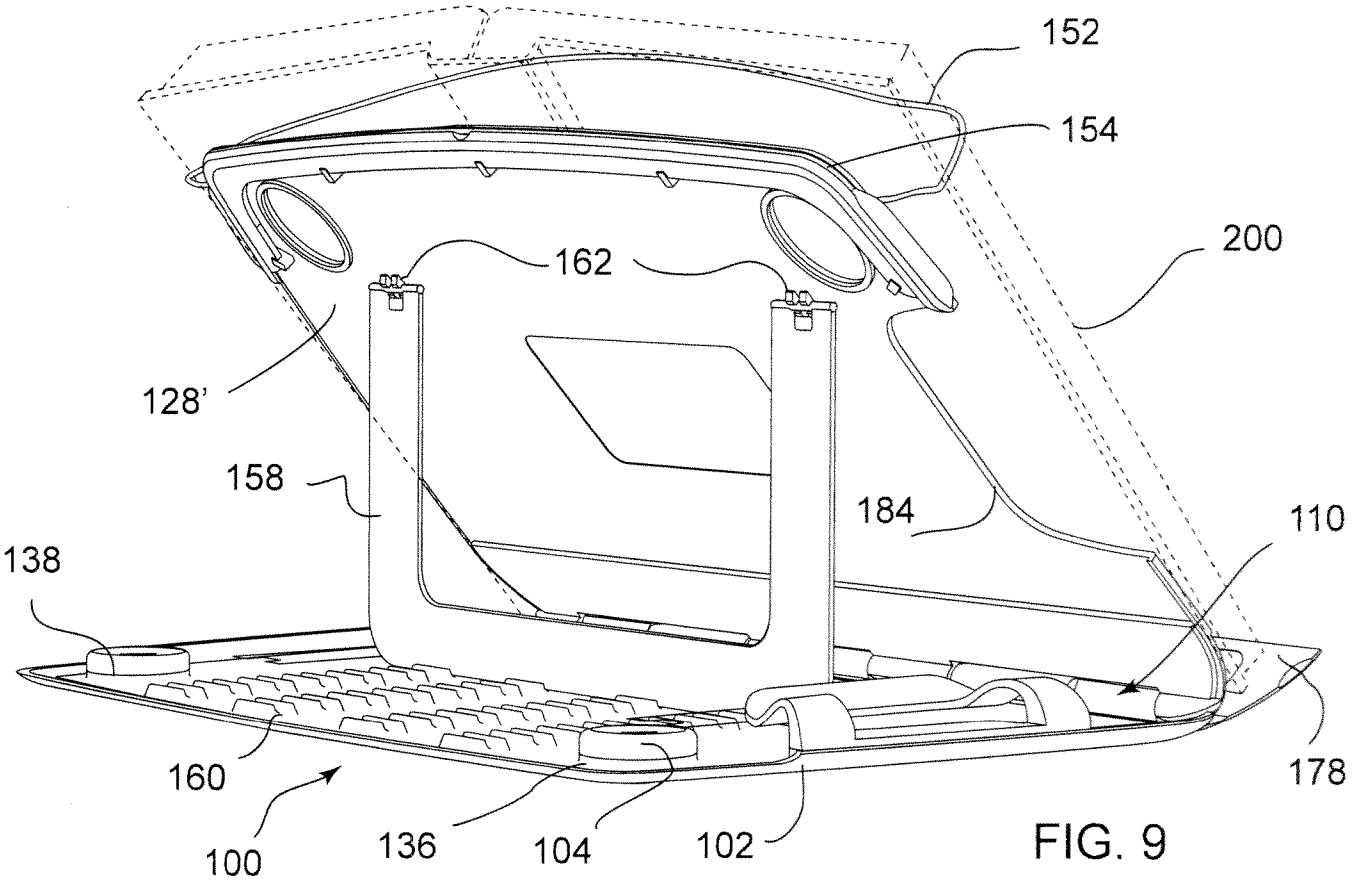
FIG. 9 shows a rear perspective view of the collapsible support device of FIG. 8.
Figure 18:
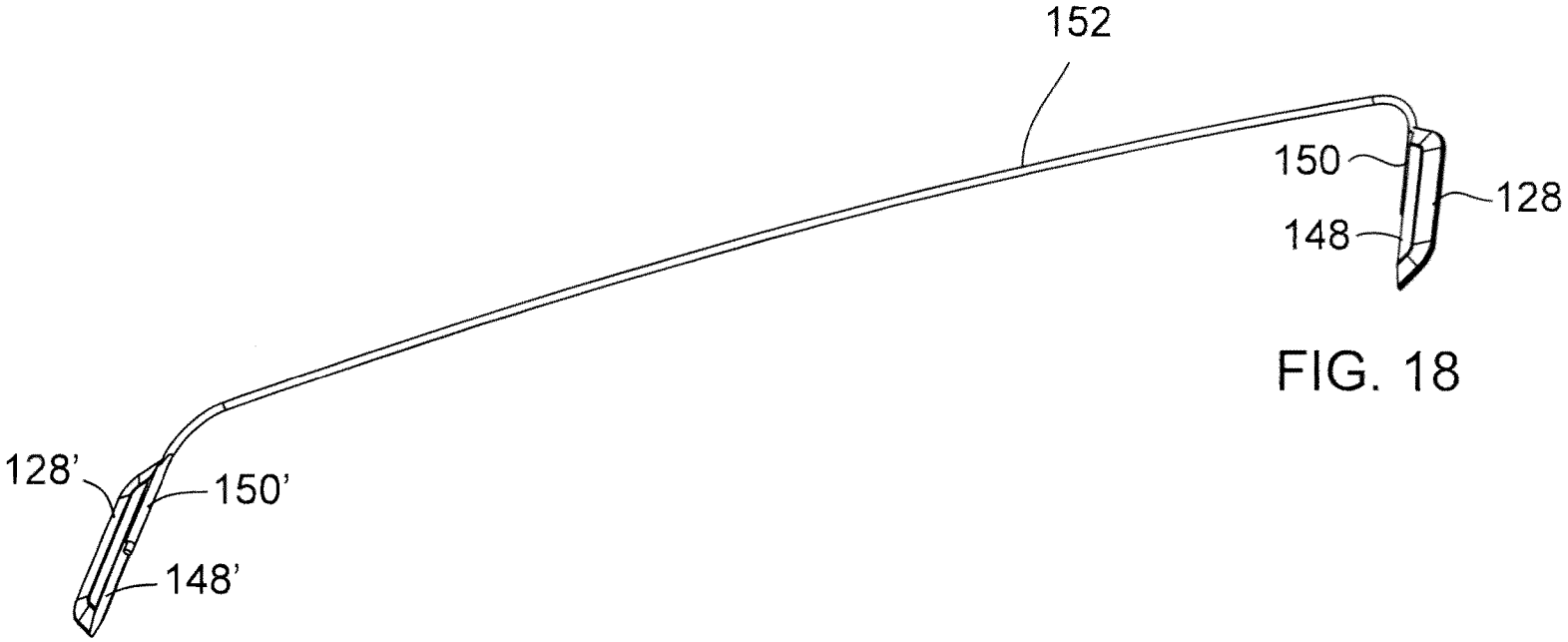
FIG. 18 shows a perspective view of an elastic band between two tabs for the collapsible support device of FIG. 1.

As to the elastic band 152, this elastic band fits inside a groove 154 (best seen in FIG. 9) in the upper support panel 108 that runs along at least part of a periphery of the upper support panel. In this case, the elastic band 152 runs long the fourth edge 134. The first and second ends of the elastic hand 152 are attached to the upper support panel 108 at the tabs 128, 128' such that the elastic band 152 fits inside the groove 154 when the collapsible support device is in the closed position. Also, the elastic band 152 is configured to stretch over the upper surface 124 of the upper support panel 108 so as to be able to hold the object 200 on the upper surface 124 when the collapsible support device 100 is in the at least one open position, as seen in FIGS. 8-9, and to contract back into the groove 154 when the collapsible support device 100 is in the closed position. As seen in FIGS. 8-9 and 18, the first and second ends of the elastic hand 152 terminate at the first and second tabs 128, 128', respectively. According to other embodiments, the first and second ends of the elastic band may terminate at or substantially near the corners of the upper support panel 108 without the use of tabs 128, 128' (that is, tabs 128, 128' may not be present in these embodiments). The material of the elastic band 152 may be any suitable stretchable material, such as, for example, a cotton polyester elastic blend woven band, or a band made of thermoplastic elastomer (rubberized polypropylene), such as Santoprene®. Furthermore, the diameter of the elastic band may be any suitable diameter, such as for example, between 1/16" and 1/8", and preferably about 3/32". The groove 154 in which the elastic band fits may correspond to the diameter of the elastic band so as to provide a flush appearance to prevent the elastic band from being unduly snagged by external forces.

Figure 15:
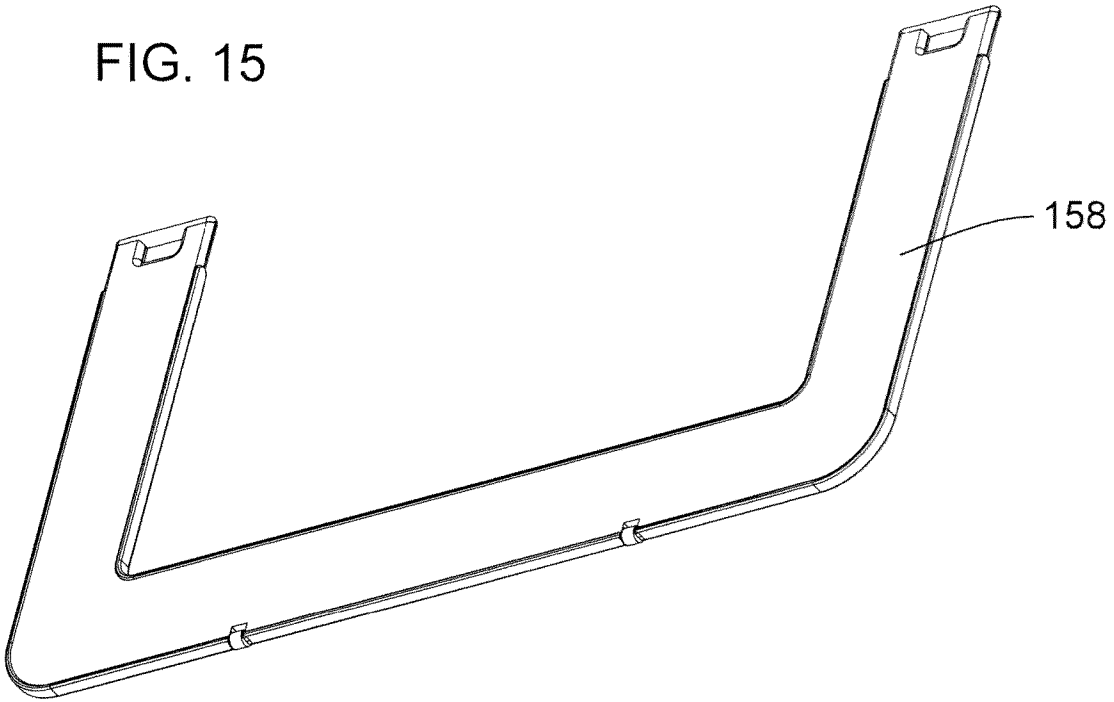
FIG. 15 shows a perspective view of a support bracket for the collapsible support device of FIG. 1.
Figure 16A:
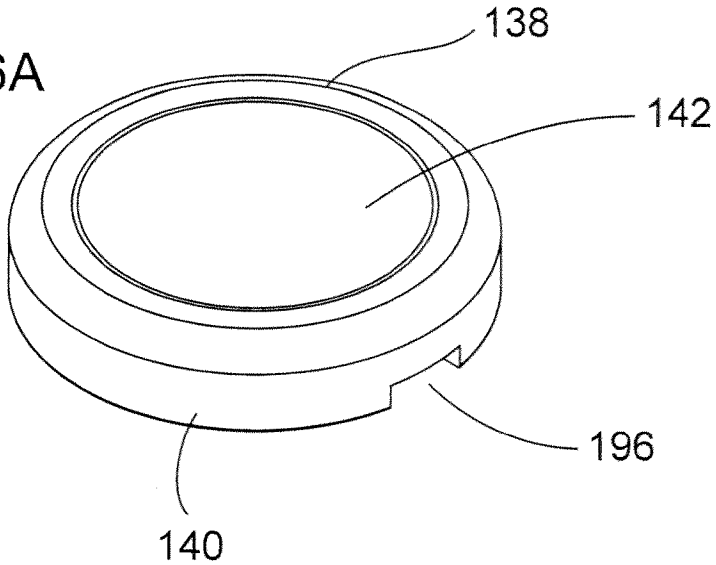
Figure 16B:
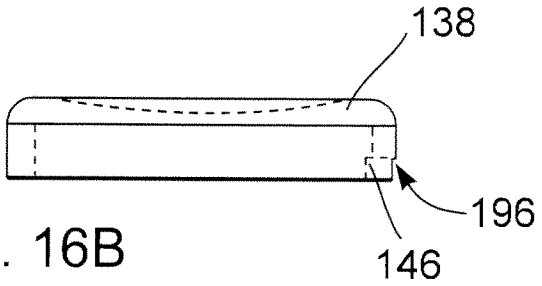
Figure 17B:
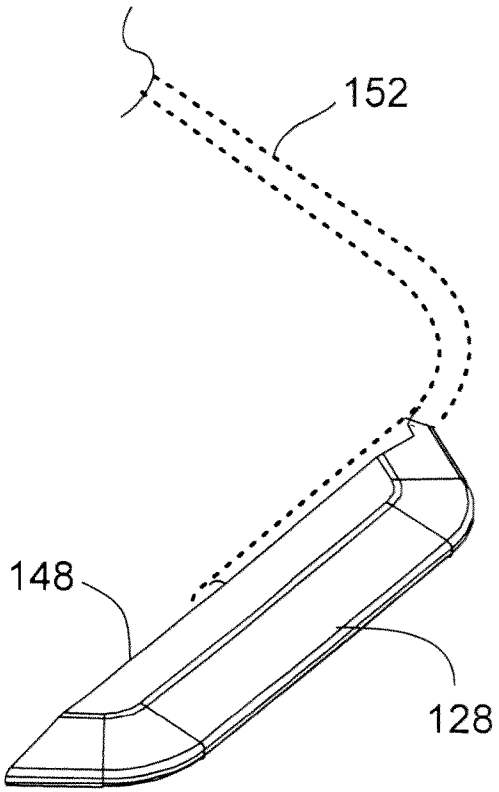
Figure 17A:
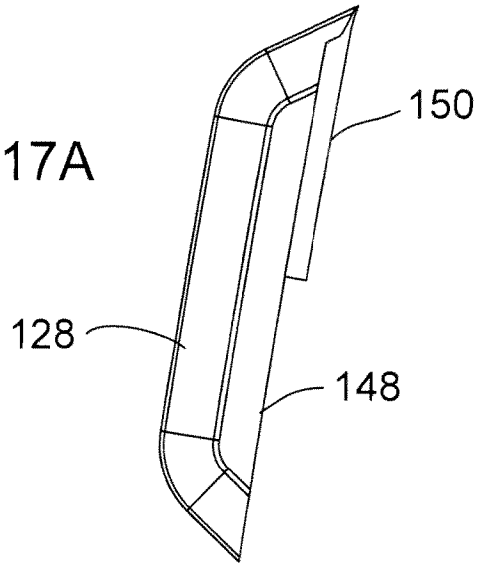

As seen in FIGS. 7-10, a support bracket 158 may be disposed between the upper support panel 108 and the base portion 102. The support bracket 158 is configured to keep the base portion 102 and the upper support panel 108 are at the angle relative to each other when in the at least one open position. As seen in FIG. 15, the support bracket 158 is pivoted downward from the upper support panel 108 and held at an angled position by a pair of notches 160 (seen in FIG. 12) molded in the upper surface 106 of the base portion 102. There may be a plurality of pairs of notches 160. The support bracket 158 may be U-shaped and connected at hinge joints 162 on the flat surface 124 of the upper support panel 108. The angular position of the upper support panel 108 can be varied by moving the legs of the U-shape of the support bracket 158 into a different pair of notches; thus creating a plurality of different open positions. With the support bracket and notches, the upper support panel 108 may be in one of a variety of inclined positions at an acute angle $\alpha$ from the base portion. For example, the angle $\alpha$ may be in a range of about 15° to about 85°, preferably in range of about 25° to 75°, more preferable in a range of about 30° to about 65°. The number of pairs of notched may be any suitable number, such as one, two, four, six, or more or any integer therebetween. The pairs of notches may or may not be equidistant from each other. Further, the notches may be thin (FIG. 12) or thick (FIGS. 7-8) and/or used in pairs in each position (FIG. 12) or in sets of three or more in each position (FIG. 9) or may be a single notch per position. According to another embodiment, the hinge joints 162 may be on the flat surface of the base portion while the notches 160 or other holding mechanism is located in the upper support panel 108.

Figure 13A:
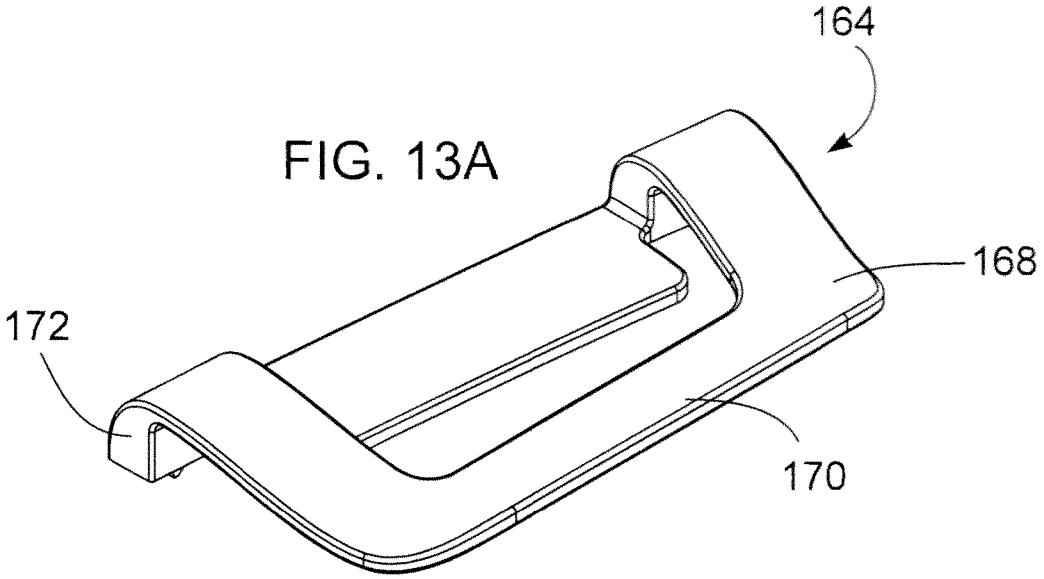
Figure 13C:
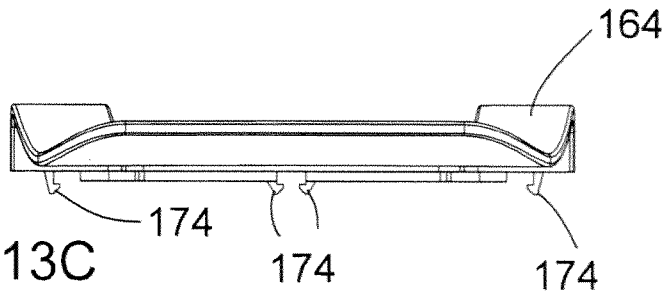
Figure 13B:
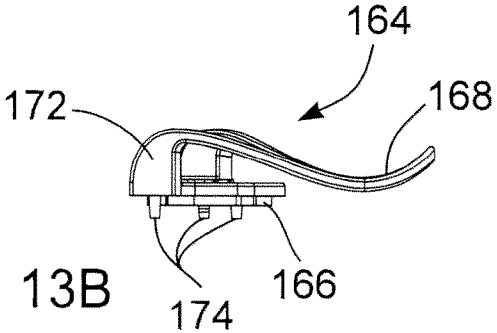

As seen in FIGS. 1, 13A-13C, and 14, the collapsible support device 100 may optionally have a clip 164 configured to bias towards the base portion 102 and to extend above the upper support panel 108 when the collapsible support device 100 is in the closed position, as seen in FIG. 1. The clip permits the collapsible support device to be used as a clipboard when in the closed position. To accommodate the clip, the upper support panel 108 also includes contains a clip recess 184 which extends around the clip 178. The clip 164 may have a mounting base 166 for attachment to the base portion 102 and a spring portion 168. The spring portion 168 includes an end portion 170 that abuts, substantially abuts, or is substantially close to the base portion, and an anchor portion 172 that connects the spring portion to the mounting base 166. The end portion 170 may be pulled outward from the base portion 102 while the anchor portion 172 remains fixed to the base portion 102 through the mounting base 166. The spring portion may take any suitable shape, such as, for example, a U-shape (as seen in FIGS. 13A-13C), a semi-circle, a half-oval, a rectangular shape, other polygonal shapes, or the like. According to another embodiment of the present invention, the clip may be a spring loaded clip mounted in the base portion 102 such that the spring loaded clip extends above the upper support panel 108 when the support is in the closed position.

Figure 14:
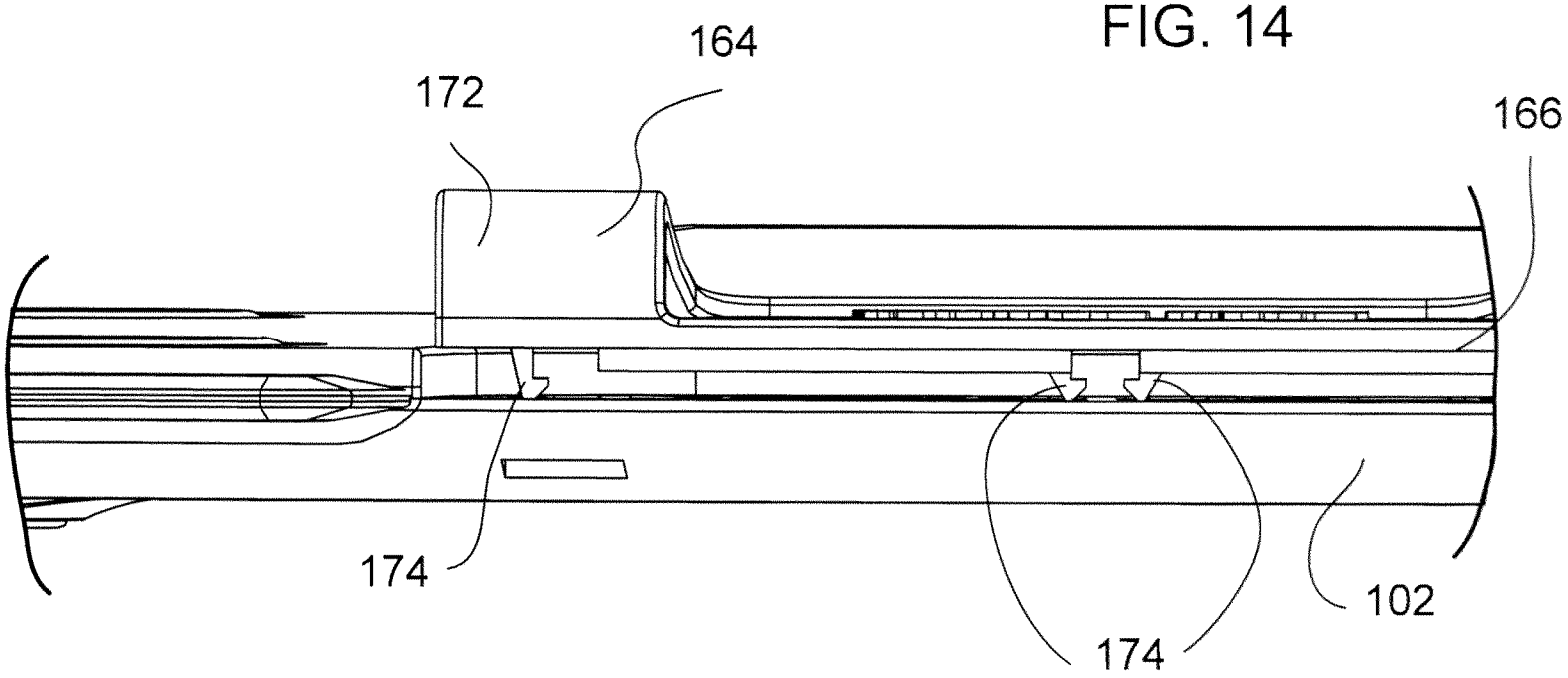
FIG. 14 shows a side view of the collapsible support device of FIG. 1 in which the clip is inserted into the base portion.

The mounting base 166 includes a plurality of hooks 174 that can be inserted into a corresponding plurality of apertures 176 in the base portion 102 (see FIG. 12). Once the hooks 174 are inserted into the apertures 176, as seen in FIG. 14, the clip 164 becomes affixed to the base portion 102. Other attachment mechanisms may be used.

The collapsible support device may further comprise a lip 178 connected to the hinge 110 and configured to rotate between a position aligned with the upper support panel 108 when the collapsible support device 100 is in the closed position (as seen in FIG. 1) and a position extending upwardly from the upper support panel 108 when the collapsible support device 100 is in the at least one open position (as seen in FIGS. 7-10). The lip 178 may extend along a portion, a substantial portion, or the entire length of the edge 114.

The lip 178 is connected to hinge 110 so as to be pivotable relative to the base portion 102, and the upper support panel 106. According to the embodiment of FIGS. 1 and 4, the lip has hinge parts 182 that are integrally formed as one-piece with the lip 178, and are similar to the hinge parts 116 and 118. The hinge parts 182 may be included in the series of hinge parts 116 and 118 along the pivot rod 120.

Figures 3A, 3B, 3C:
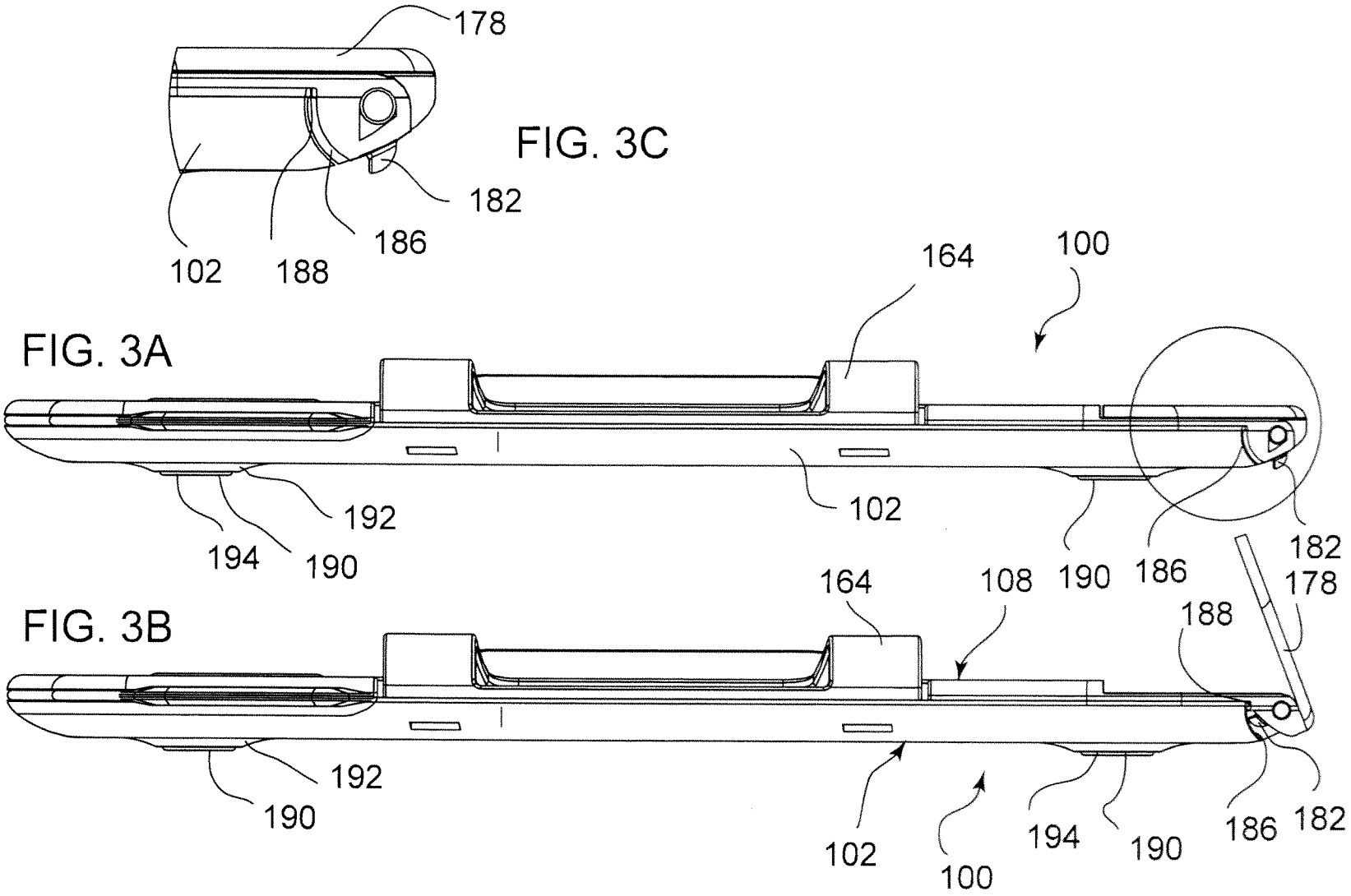

As seen in FIG. 1, the upper support panel 108 may contains a recess 180 to receive lip 178. In the closed position, the 178 is received in the recess 180 so that the upper surface of lip 178 is aligned or flushed with the upper surface of upper support panel 108 to form a planar writing surface. As seen in FIGS. 3A-3C, one or more tabs 182 may be used to facilitate removal of the lip 178 from the recess 180. According to an alternative embodiment, recesses may be formed in the upper support panel 108 and the lip 178, respectively, to facilitate removal of the lip 178 from the recess 180, see U.S. Pat. No. 4,555,128.

In the inclined position, the lip 178 may be rotated out so that it is approximately 90° from the upper support panel 108 in a use position, as shown in FIGS. 7-10. The one or more tabs 182 may prevent rotation of the lip 178 beyond the use position. For example, when the lip 178 is being rotated from its position in the recess 180 to the use position the one or more tabs 182 may enter into a groove, slot, recess or opening 186 until the one or more tabs 182 contact an end surface 188 to prevent further rotation.

Figure 2:
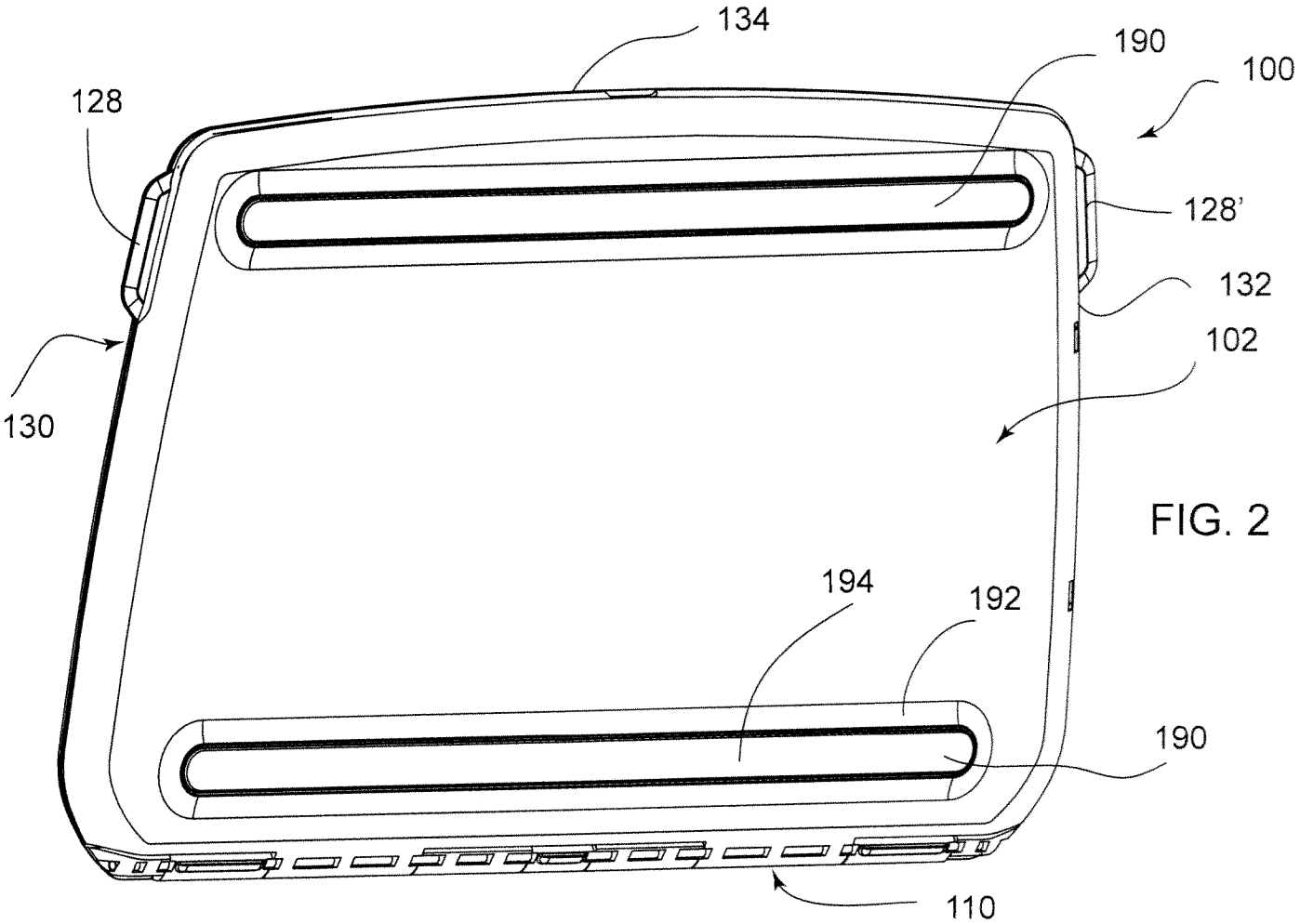
FIG. 2 shows a perspective bottom view of the collapsible support device of FIG. 1.

As seen in FIGS. 2, 3A, and 3B, the base portion may optionally comprise at least two feet 190 configured to inhibit or prevent sliding. The at least two feet may comprise a molded base 192 that protrudes from the base portion 102 and an anti-slipping material 194, such as rubber, affixed to the molded base. In FIG. 2, the number of feet is two and the feet are elongated so that they extend over most of the length of the base portion. According to other embodiments, the number of feet may be three, four, or more. Also, the shape of the feet may be circular, rectangular, square, polygonal, oval, or other shapes.

According to one embodiment of the present invention, the base portion 102, the upper support panel 108, the tab 128, 128', the support bracket 158, the clip 164, the lip 178, and or any combination thereof may be formed of any suitable plastic. For example, the base portion 102, the upper support panel 108, the tab 128, 128', the support bracket 158, the clip 164, the lip 178, or any combination thereof may comprise molded plastic. According to one embodiment, the base portion 102, the upper support panel 108, the tab 128, 128', the support bracket 158, the clip 164, the lip 178, and or any combination are injection molded from any durable synthetic resin or polymer, such as, for example, acrylonitrile-butadiene-styrene (ABS). Of course, for this embodiment, the design of these elements must be adapted to suit the injection molding process.

According to other embodiments of the present invention, different materials may be used for any, some, or all the base portion 102, the upper support panel 108, the tab 128, 128', the support bracket 158, the clip 164, and the lip 178, such as, for example, metal, metal alloy, nylon, polyethylene, polystyrene, polypropylene (PP), polycarbonate (PC), polystyrene, or any combination.

With the assembly of the collapsible support device 100 as described above, the collapsible support device 100 is configured to move into the at least one open position, as depicted in FIGS. 7, 8, 9, and 10, upon an application of a first force $F_1$ on the at least one protrusion 104, 104' and an application of a second force $F_2$ on the at least one tab 128, 128' as seen in FIG. 1. The first force $F_1$ and second force $F_2$ may act upon in opposite directions or in substantially opposite directions. The at least one open position may be any of the positions depending upon which notches 160 the support bracket 158 is placed.

To further elaborate, a method of supporting an object 200 at an inclined position using the collapsible support device 100 will be described with reference to FIG. 19.

In step S1, the method may first comprise placing at least first and second lingers 202 and 204 on the collapsible support device 100. If the collapsible support device comprises one protrusion 104 located adjacent to the midpoint of the fourth edge 134, the first finger may be a thumb on the protrusion while the second finger may be the index finger on the tab protruding from the midpoint of the fourth edge 134. If the collapsible support device 100 comprises two protrusions 104, 104' and two tabs 128, 128' (such as seen in FIG. 1), the first finger may be a thumb on each protrusion while the second finger may be an index finger on each tab.

Figure 6:
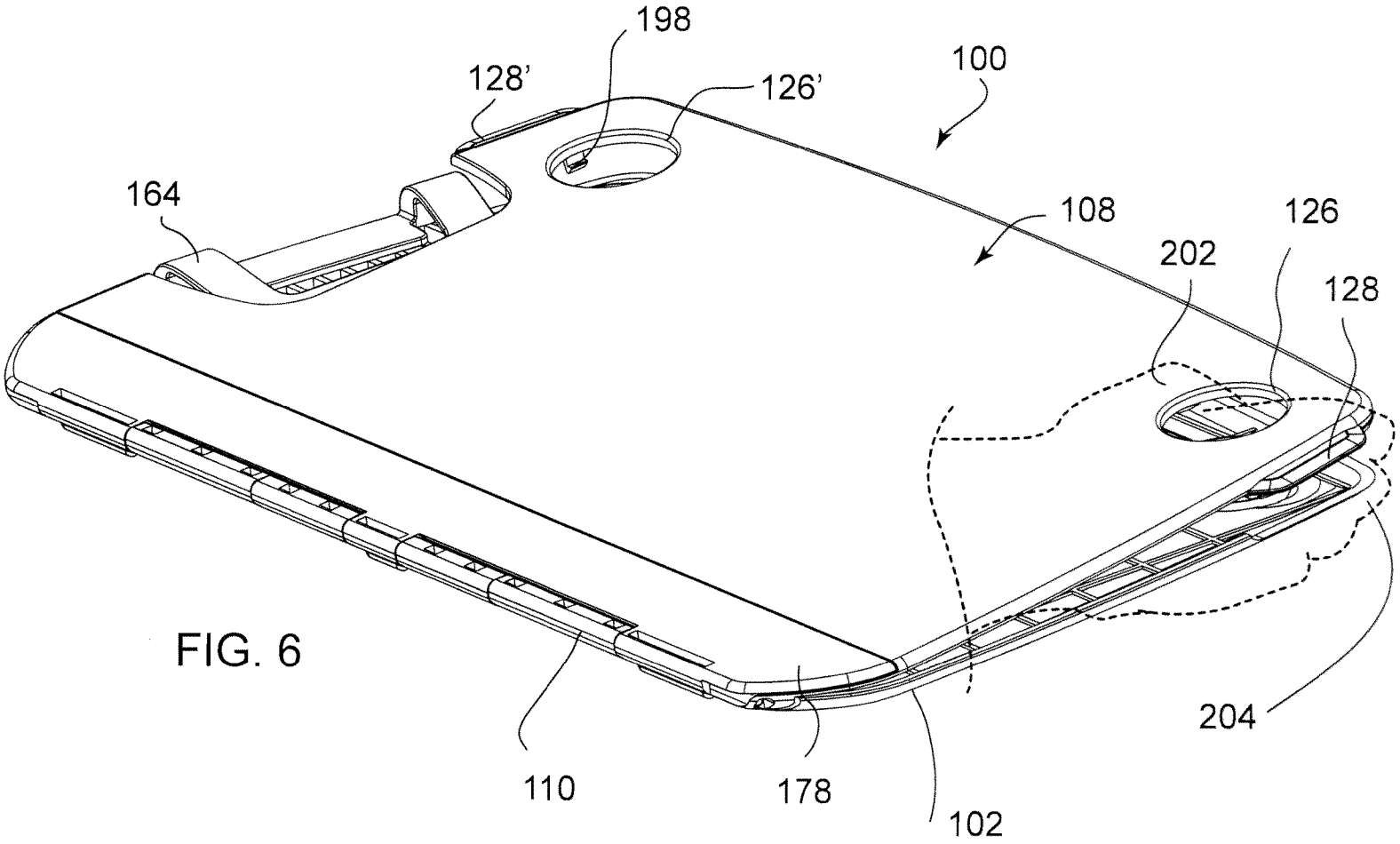
FIG. 6 shows a perspective top view of a user opening the collapsible support device of FIG. 1.
Figure 7:
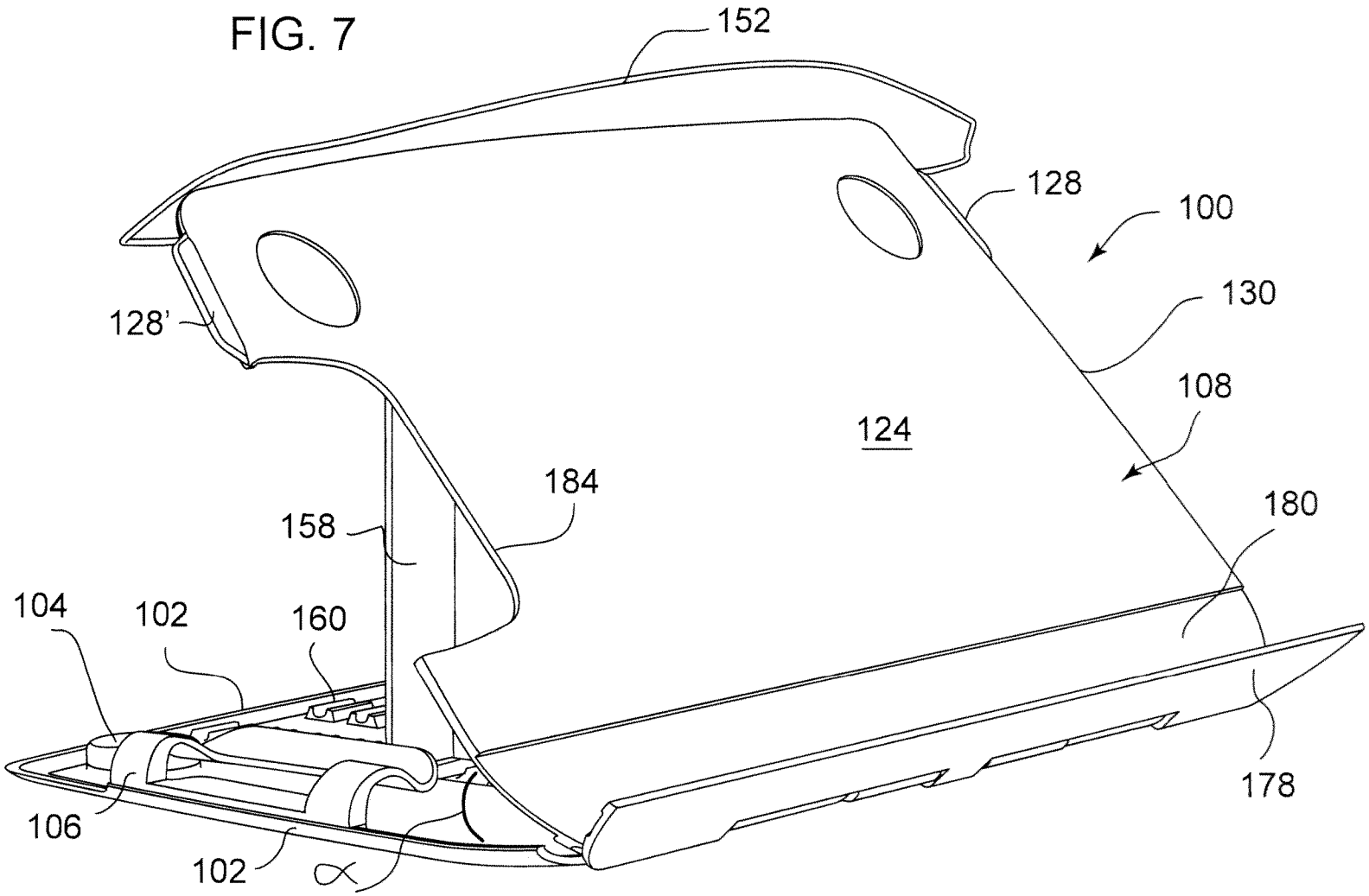
FIG. 7 shows a perspective top view of the collapsible support device of FIG. 1 in an open position.

In step S2, a first force $F_1$ is applied on the at least one protrusion 104, 104' in a first direction with the first finger 202 and a second force $F_2$ is applied on the at least one tab 128, 128' in a second direction with the second finger 204 such that the protrusion 104, 104' is removed from the aperture 126, 126'. The application of the first and second forces may occur at the same time or at substantially the same time while the first and second directions are in opposite directions or in substantially opposite directions, as seen in FIG. 1. With this step, as seen in FIG. 6, the interlocking of the tab 198 in the aperture 126 with the notch 196 of the protrusion 104 is forcibly released such that the collapsible support device is not locked in the closed position.

In step S3, the upper support panel 108 is rotated relative to the base portion 102 about the hinge 110.

In step S4, the upper support panel 108 is fixed relative to the base portion 102 in at least one open position. The upper support panel 108 may be fixed relative to the base portion 102 in the at least one open position by disposing the support bracket 158 between the upper support panel 108 and the base portion 102 such that the base portion 102 and the upper support panel 108 are at an angle α relative to each other when in the at least one open position. The support bracket, for example, may be rotated about the hinge joints 162 from a flat position against one of the upper support panel and the base portion to an angled position relative to the one of the upper support panel and the base portion so as to lit in a notch in the other of the upper support panel and the base portion. Based on the configuration of the support bracket 158 and notches 160, the upper support panel 108 may be in one of a variety of inclined positions at an acute angle α from the base portion. Any one of the inclined positions may be considered an open position.

Figure 10:
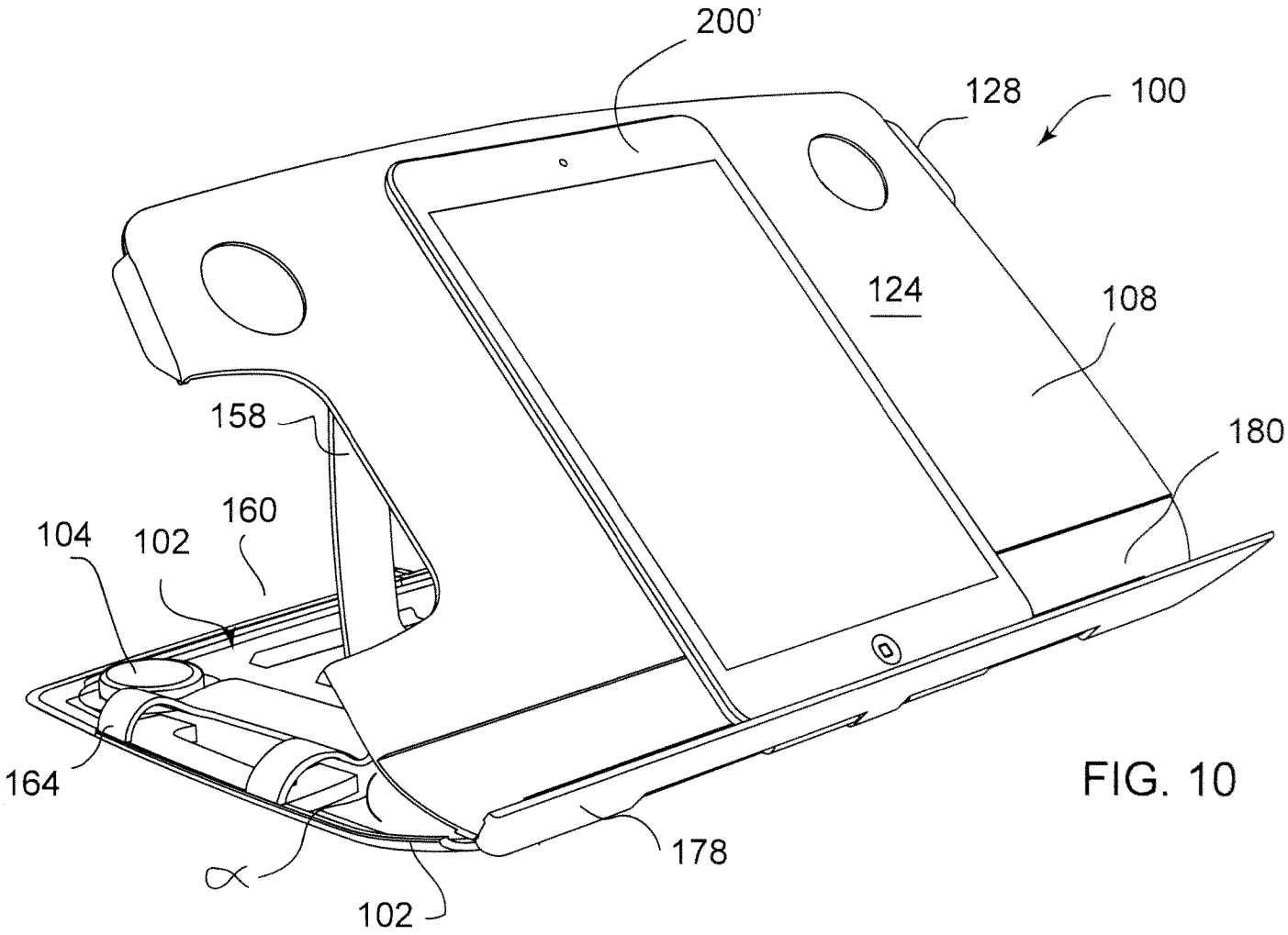
FIG. 10 shows a perspective top view of the collapsible support device of FIG. 1 in an open position with an object placed thereon.

In step S5, the object 200, 200' is placed on the upper support panel 108, as seen in FIGS. 8, 9, and 10, with the use of the lip 178, which is rotated open either sequentially or simultaneously with the rotation of the upper support panel 108 relative to the base portion 102. The object may, for example, be a hook, an electronic device, a poster board, a note pad, or other substantially planar objects.

In step S6, an elastic band 152 may be stretched from the groove 154 running along at least part of a periphery of the upper support panel 108 over the upper surface 124 of the upper support panel 108 so as to hold the object 200 on the upper surface when in the at least one open position. Step S6 is an optional step and need not be performed. For example, if the object is an electronic device 200', as seen in FIG. 10, no elastic band is needed. In contrast, the step S6 may be used for such items that would be made more stable with the use of such elastic band. For example, if the object 200 were a book, as seen in FIGS. 9-10, the elastic band 152 would be useful in ensuring that the pages of the book be held in a fixed location.

Figure 19:
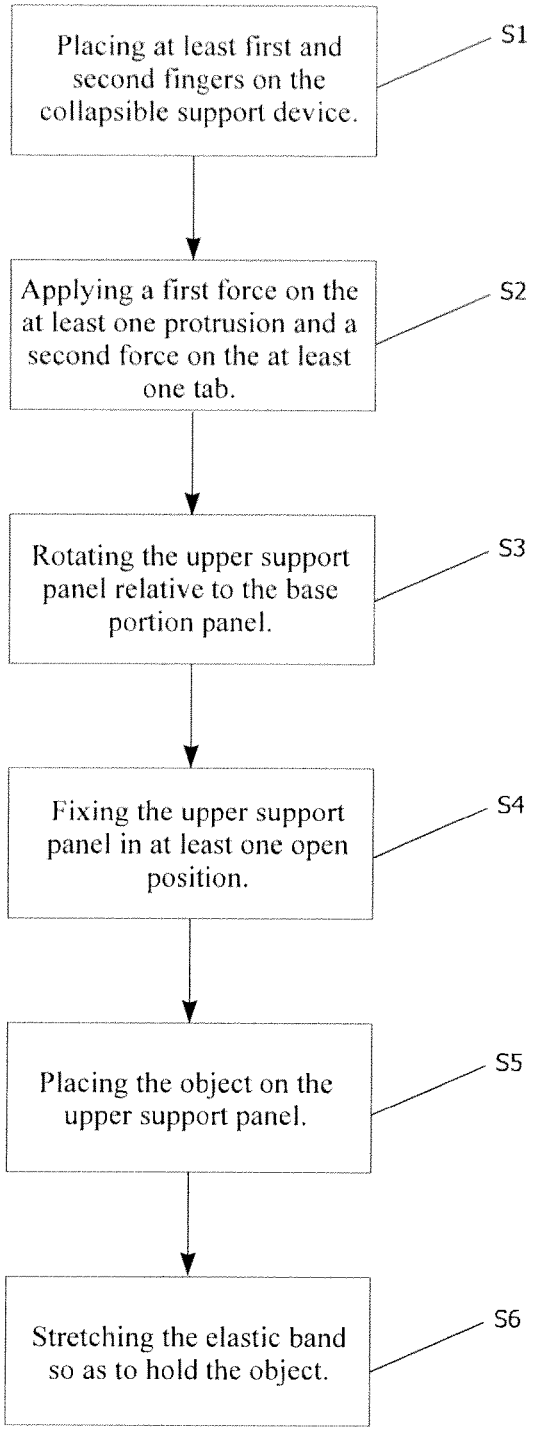
FIG. 19 shows a flowchart of a method for supporting an object at an inclined position using a collapsible support device according to one embodiment of the present invention.

To place the collapsible support device 100 back into the closed position, the steps in FIG. 19 are essentially reversed. For example, if the elastic band 152 is being used, it is contracted back into the groove 154 running along the at least part of a periphery of the upper support panel 108. The object 200, 200' is removed from the upper support panel 108 and the lip 178. The support bracket 158 is removed from its notches 160 and rotated about the hinge joints 162 so as to go into the flat position against the one of the upper support panel and the base portion to which the hinge joints are attached. Thus, the upper support panel 108 is no longer fixed relative to the base portion 102, but is rotatable relative to the base portion. The upper support panel 108 is rotated relative to the base portion 102 about the hinge 110 so as to lay against the base portion 102. The lip 178 may be rotated either sequentially or simultaneously with the rotation of the upper support panel 108 relative to the base portion 102 so as to go back into the recess 180. The at least one protrusion 104, 104' enters into its corresponding aperture 126, 126' such that the interlocking of the tab 198 with the notch 196 is restored such that the collapsible support device is locked in the closed position.

Besides those embodiments depicted in the figures and described in the above description, other embodiments of the present invention are also contemplated. For example, any single feature of one embodiment of the present invention may be used in any other embodiment of the present invention. For example, a collapsible support device configured to support an object in an inclined position and/or a method of supporting an object at an inclined position using a collapsible support device may comprise any one or more of the following features (1)-(28) in any combination:

(1) a base portion having at least one protrusion that extends from an upper surface of the base portion:

(2) an upper support panel;

(3) a hinge connecting the base portion to the upper support panel is disposed at one edge of the base portion and a first edge of the upper support panel;

(4) the collapsible support device is configured to be in at least one open position such that the base portion and the upper support panel are at an angle relative to each other and to be in a closed position such that the upper support panel lays against the base portion;

(5) the upper support panel comprises a substantially flat surface, at least one aperture in the substantially flat surface, and at least one tab protruding from a second edge of the upper support panel;

(6) the at least one protrusion is configured to lock the collapsible support device in the closed position when the at least one protrusion extends through the at least one aperture;

(7) the at least one protrusion is located in a corner of the base portion, and the at least one aperture is formed in at least one corner of the upper support panel;

(8) the base portion has a second protrusion that extends from the upper surface of the base portion, wherein the upper support panel comprises a second aperture in the substantially flat surface and a second tab protruding from a third edge of the upper support panel, and wherein the second protrusion is configured to lock the collapsible support device in the closed position when the second protrusion extends through the second aperture;

(9) the collapsible support device is configured to move into the at least one open position upon an application of a first force on the at least one protrusion and an application of a second force on the at least one tab, and wherein the first force and second force are acting upon in opposite directions;

(10) a support bracket disposed between the upper support panel and the base portion and configured to keep the base portion and the upper support panel at the angle relative to each other when in the at least one open position;

(11) a clip configured to bias towards the base portion and to extend above the upper support panel when the collapsible support device is in the closed position;

(12) the upper support panel, the clip, or a combination thereof comprises molded plastic;

(13) a lip connected to the hinge and configured to rotate between a position aligned with the upper support panel when the collapsible support device is in the closed position and a position extending upwardly from the upper support panel when the collapsible support device is in the at least one open position;

(14) the base portion comprises at least two feet, wherein the at least two feet are configured to inhibit or prevent sliding;

(15) a base portion;

(16) the upper support panel comprises a groove running along at least part of a periphery of the upper support panel;

(17) an elastic hand having first and second ends attached to the upper support panel such that the elastic hand fits inside the groove when the collapsible support device is in the closed position;

(18) the elastic band is configured to stretch over an upper surface of the upper support panel so as to be able to hold the object on the upper surface when the collapsible support device is in the at least one open position and to contract back into the groove when the collapsible support device is in the closed position;

(19) the First and second ends of the elastic hand terminate at the one and second tabs, respectively;

(20) placing at least first and second fingers on the collapsible support device;

wherein at least one protrusion is configured to extend through at least one aperture so as to keep the collapsible support device is in the closed position;

(21) applying a first force on the at least one protrusion in a first direction with the first finger and a second force on the at least one tab in a second direction with the second finger such that the protrusion is removed from the aperture;

(22) rotating the upper support panel relative to the base portion about the hinge;

(23) fixing the upper support panel relative to the base portion in at least one open position;

(24) placing the object on the upper support panel;

(25) application of the first and second forces occur at a same time or at substantially the same time;

(26) the first and second directions are in opposite directions or substantially opposite directions;

(27) stretching an elastic band from a groove running along at least part of a periphery of the upper support panel over the substantially flat surface of the upper support panel so as to hold the object on the substantially flat surface when in the at least one open position;

(28) fixing the upper support panel relative to the base portion in the at least one open position comprises disposing a support bracket between the upper support panel and the base portion such that the base portion and the upper support panel are at an angle relative to each other.

As utilized herein, the terms "approximately," "about," "substantially," and similar terms are intended to have a meaning in harmony with the common and accepted usage by those of ordinary skill in the art to which the subject matter of this disclosure pertains. For example, the terms "approximately," "about," "substantially," and similar terms may mean +/−10% of the value or term they modify, or +/−5% of the value of term they modify.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A collapsible support device configured to support an object in an inclined position, comprising:

a base portion having a first protrusion that extends from an upper surface of the base portion; and an upper support panel having a lower surface, a substantially flat upper surface, and first, second, third, and fourth peripheral edges, wherein the first edge is opposite the fourth edge, and the second edge is opposite the third edge;

a hinge connecting the base portion to the upper support panel, the hinge being disposed at one edge of the base portion and at the first edge of the upper support panel; and an elastic band having first and second ends attached to the upper support panel, wherein the collapsible support device is configured to be in at least one open position such that the base portion and the upper support panel are at an angle relative to each other and to be in a closed position such that the upper support panel lays against the base portion, wherein the upper support panel comprises a first aperture having a closed periphery, the first aperture extending through the upper support panel from the inner surface to the outer surface of the upper support panel, wherein a first tab protrudes from the second edge of the upper support panel such that the first tab protrudes beyond portions of the second edge adjacent to the first tab, and wherein the first protrusion is configured to lock the collapsible support device in the closed position when the first protrusion extends through the first aperture, wherein the upper support panel includes a groove that extends in and along at least the fourth edge of the upper support panel, and the elastic band is configured to fit inside the groove when the elastic band is in an unstretched state, wherein the collapsible support device is configured to move into the at least one open position from the closed position upon application of (i) a first force on the first protrusion in a first direction with a first finger via the first aperture, and (ii) a second force on the first tab in a second direction, opposite the first direction, with a second finger.

2. The collapsible support device according to claim 1, wherein the first aperture is located at a corner of the upper support panel at which the second edge meets the fourth edge, and the first protrusion is located at a corresponding corner of the base portion.

3. The collapsible support device according to claim 2, wherein the base portion has a second protrusion that extends from the upper surface of the base portion, wherein the upper support panel comprises;

a second aperture having a closed periphery, the second aperture extending through the upper support panel from the inner surface to the outer surface of the upper support panel, and a second tab protruding from the third edge of the upper support panel, wherein the second protrusion is configured to lock the collapsible support device in the closed position when the second protrusion extends through the second aperture, and wherein the second aperture is located at a corner of the upper support panel at which the third edge meets the fourth edge, and the second protrusion is located at a corresponding corner of the base portion.

4. The collapsible support device according to claim 1, further comprising a support bracket disposed between the upper support panel and the base portion and configured to keep the base portion and the upper support panel at the angle relative to each other when in the at least one open position.

5. The collapsible support device according to claim 1, further comprising a clip configured to bias towards the base portion and to extend above the upper support panel when the collapsible support device is in the closed position.

6. The collapsible support device according to claim 5, wherein the upper support panel, the clip, or a combination thereof comprises molded plastic.

7. The collapsible support device according to claim 1, further comprising a lip connected to the hinge and configured to rotate between a position aligned with the upper support panel and a position extending upwardly from the upper support panel.

8. The collapsible support device according to claim 1, wherein the base portion comprises at least two feet, and wherein the at least two feet are configured to inhibit or prevent sliding.

9. The collapsible support device according to claim 3 wherein the first and second ends of the elastic band terminate at the first and second tabs, respectively.

10. The collapsible support device according to claim 9, wherein the first and second tabs are formed separate from a remainder of the upper support panel, the first end of the elastic band is attached to the first tab, and the second end of the elastic band is attached to the second tab, such that the elastic band is attached to the upper support panel via the first and second tabs.

* * * * *